United States Patent [19]

Hessel et al.

[11] Patent Number: 4,506,533

[45] Date of Patent: Mar. 26, 1985

[54] METHOD OF FORMING SEAMLESS DRAWN AND IRONED CONTAINERS OF ALUMINUM STOCK

[76] Inventors: William Hessel, 706 70th St., Darien, Ill. 60559; Wayne D. Niemeyer, 1171 Londonberry La., Glen Ellyn, Ill. 60137; Surya K. Misra, 465 Menominee La., Naperville, Ill. 60540; Richard A. Openchowski, 7012 Slayton, Woodridge, Ill. 60515

[21] Appl. No.: 572,056

[22] Filed: Jan. 19, 1984

Related U.S. Application Data

[63] Continuation-in-part of Ser. No. 259,231, May 11, 1981, abandoned, which is a continuation-in-part of Ser. No. 149,850, May 14, 1980, abandoned.

[51] Int. Cl.[3] ..... B21D 51/26; B21D 22/28

[52] U.S. Cl. ..... 72/42; 413/1

[58] Field of Search ..... 72/41, 42, 46; 252/56 R, 56 S; 428/327, 340, 341, 411, 458

[56] References Cited

U.S. PATENT DOCUMENTS

| | | | |
|---|---|---|---|
| 2,938,262 | 5/1960 | Barker et al. | 72/42 X |
| 3,749,598 | 7/1973 | Kushima et al. | 428/341 X |
| 3,826,675 | 7/1974 | Smith et al. | 252/52 S X |
| 3,945,930 | 3/1976 | Sugiyama et al. | 72/42 X |
| 4,193,881 | 3/1980 | Baur | 72/42 X |
| 4,235,947 | 11/1980 | Asano et al. | 72/42 X |
| 4,237,021 | 12/1980 | Andlid et al. | 72/42 X |
| 4,445,813 | 5/1984 | Misra et al. | 72/42 X |

*Primary Examiner*—E. Michael Combs

[57] ABSTRACT

A method of forming a drawn and ironed aluminum container is disclosed herein. The aluminum stock material is initially provided with a thin layer of a particular lubricant applied to one or both surfaces thereof. The lubricant is unemulsified (i) peanut oil and/or (ii) certain oleic acid esters of aliphatic polyhydric alcohols. The method contemplates applying the thin layer of said lubricant to an aluminum stock, cutting a disc and forming a drawn and ironed container utilizing said lubricated disc without additional lubricant being applied to the tooling.

14 Claims, No Drawings

METHOD OF FORMING SEAMLESS DRAWN AND IRONED CONTAINERS OF ALUMINUM STOCK

DESCRIPTION

Reference to Related Applications

This application is a continuation-in-part of U.S. Ser. No. 259,231, filed May 11, 1981, abandoned which, in turn, is a continuation-in-part of U.S. Ser. No. 149,850, filed May 14, 1980 abandoned.

TECHNICAL FIELD

Our present invention relates to an improved method for forming seamless drawn and ironed containers from aluminum stock which involves the utilization of certain particular lubricants.

BACKGROUND PRIOR ART

The use of a two-piece container for packaging products such as beer and/or carbonated beverages has become very popular in recent years. The two-piece container generally is a container sidewall or body with a unitary end wall at one end thereof. The second piece of the container comprises an end seamed to the open end of the container in a fluid-tight manner.

Typically, a two-piece aluminum container may be produced by initially cutting a disc from a sheet or coil of stock aluminum, and substantially simultaneously transforming the disc into a shallow cup in a conventional cupping machine forming a part of a can manufacturing line. The shallow cup is then converted into a drawn and ironed container of desired dimensions in a body maker by ramming the cup through a plurality of forming die rings on a punch in a known manner to progressively decrease the wall thickness of the reformed cup and produce a seamless container, as described in detail in an article appearing in the November, 1973, AEROSOL AGE magazine entitled "The Drawn and Ironed Can—Understanding the Technology".

In general, conventional commercial machinery which form the cups for conversion to drawn and ironed aluminum containers utilizes a lubricant in the cup-making device or cupper to provide the necessary lubricity between the surface of the stock material and the tooling. The container-body-making machinery also incorporates a mechanism for flowing a coolant onto the surface of the container and to the ironing dies utilized in cooperation with the punch. Typically, the lubricant which has been generally conventionally commercially used in the manufacture of seamless drawn and ironed containers of aluminum stock, particularly in the cupping step, is a water-diluted neat emulsified oil-blend lubricant, such as a commercially available Texaco brand 591 product. Criteria which such lubricants must meet to be commercially acceptable include the following qualities: good lubricity at high pressure and temperature; good emulsion stability; easy washability from the can surface; good availability; and inexpensiveness.

Considerable effort has gone into finding and developing lubricants which meet the exacting requirements for optimal use in the manufacture and production of two-piece aluminum containers, and illustrative of such efforts are numbers of patents. Thus, as shown in U.S. Pat Nos. 3,298,954; 3,478,554; and 3,873,458, various resin coatings containing lubricants have been suggested for use. Mixtures of polymers, mineral oil and fatty acids are disclosed in U.S. Pat. No. 4,027,070. Others have taught the application of a pretreatment procedure wherein a phosphate coating is applied prior to the application of a fatty acid, as is disclosed in U.S. Pat. Nos. 3,313,728 and 3,525,651. The special requirements for lubricating aluminum sheet are discussed in U.S. Pat. Nos. 3,783,644 and 3,832,962, where an oil-water emulsion and a thermosetting resin are used respectively. U.S. Pat. No. 3,826,675 lists some of the more important characteristics which must be satisfied by a satisfactory lubricant for metallic container stocks such as tinplate, blackplate and aluminum, and then discloses numbers of lubricants which were previously proposed for such use. Among the latter have been naturally occurring vegetable oils and synthetic esters of carboxylic acids, stated examples of which are cottonseed oil, palm oil, and synthetic esters of sebacic acid such as dioctyl sebacate. The aforesaid vegetable oils are stated to have the objection that they have a tendency to oxidize to a solid film which is no longer a good lubricant after a relatively short period of storage. The disadvantages or deficiencies of synthetic ester lubricants, even the stated best of them (dioctyl sebacate), are described in said U.S. Pat. No. 3,826,675; and it is stated therein that an entirely satisfactory lubricant was not available prior to the invention of the said patent. The invention of U.S. Pat. No. 3,826,675 resides in the use of a lubricant in the form of a citric acid ester of an alcohol containing from 1 to 10 carbon atoms in an amount of about 0.05 to 1 gram for each 67,720 square inches of lubricated surface area, illustrative examples of said citric acid ester lubricant being triethyl citrate, acetyl triethyl citrate and tributyl citrate. So far as we are aware, such citric acid ester lubricants are not being commercially used for the production of seamless drawn and ironed containers of aluminum stock. In any event, the lubricants which have been found to be highly effective in accordance with the present invention are totally different from, and unrelated to, the citric acid ester lubricants of the aforesaid U.S. Pat. No. 3,826,675.

Although there are very large numbers of materials which have lubricant properties, and there are also very large numbers of materials which have been disclosed as lubricants for use in a variety of environments in which lubricants are employed, it is well-known to those familiar with the lubricant arts that many lubricants which possess good (or reasonably satisfactory) lubricant properties for use in certain environments are of little or no value, from a practical standpoint, as lubricants in numerous other environments or for meeting particular lubricating problems. This is especially true in the field of metal container-making operations, and particularly in the field dealing with the production of seamless drawn and ironed containers from aluminum stock. Over a period of a substantial number of years, numerous lubricant problems have arisen in said container-making operations, and many types of lubricants have been suggested for use or possible use in such container-making operations, various illustrative examples being disclosed above in the prior art patents to which reference has been made. Despite all of these efforts, to the best of our knowledge and belief, the types of lubricants which have been (and are currently being) used in container-making operations by the container-making industry generally are largely mineral oil-in-water emulsions. Such mineral oil-in-water emulsions, while satisfactory in certain respects, have numbers of objections, including the fact that, as a result of the water content of such emulsions, corrosion problems arise, with the result that tooling used in the container-making operation (and particularly in the cupping operation) undergoes wear and corrosion, with the result that it is necessary to shut down the container-making operation periodically and replace the cupper tooling; and this has commonly occurred in time periods in the general range of intervals of about 3 to about 6 months.

In connection with the foregoing situation and the observations made above, that simply because a material or composition is disclosed as having lubricating properties, even generally in connection with metal deepdrawing and rolling operations, is no indication at all that such material or composition will be useful or effective as a lubricant in the production of seamless drawn and ironed containers of aluminum stock where very special and rigid conditions of use are involved, which are not met in other environments of use, and where useful or satisfactory lubrication is not obtained. As illustrative thereof, reference is made to Andlid et al U.S. Pat. No. 4,237,021, which discloses certain oil-in-water emulsions (for example, peanut oil-in-water) as being useful and effective lubricants in deforming metal working, including deepdrawing and rolling. While such lubricants are stated to be useful as lubricants in such metal working operations, they were found, by actual tests, to be unsuccessful as lubricants in producing drawn cups in a method for producing seamless drawn and ironed containers from aluminum stock. Despite the disclosed lubricant properties of the peanut oil-in-water emulsions in the Andlid et al patent, when sought to be used as lubricants in the method of producing seamless drawn and ironed containers from aluminum stock, no cups were produced, but only worthless punchouts. This fact simply serves to emphasize what has been stated above, namely, that it is impossible to predict whether a material disclosed to be a lubricant or to have lubricant properties, even broadly in metal deforming or deepdrawing and rolling operations, will have any utility at all as a lubricant for the commercial manufacture of seamless drawn and ironed containers of aluminum stock, or will be far inferior to what is already known to the container-making art, and which is distinctly inferior to what is already in commercial use in the container-making art despite its known but tolerated disadvantages.

We are also aware that it has been disclosed in U.S. Pat. No. 4,193,881 to Baur that it has been known to the art, in the manufacture of aluminum cans by a deepdrawing operation, to deposite a lubricant on the surfaces of the aluminum strip, which lubricant must satisfy a number of properties, and that paraffin oil and synthetic triglycerides previously used fulfill the requirements only in part. Synthetic triglycerides encompass a whole host of materials, no examples of any synthetic triglycerides being disclosed. It is apparent, from a chemical standpoint, that, among the numerous synthetic triglycerides, are, simply by way of example, acetic, propionic, butyric, hexoic, benzoic, pelargonic, lauric and myristic acid triglycerides; tartaric acid, citric acid, maleic acid and salicylic acic triglycerides, all of which are synthetic triglycerides, and many, many other synthetic triglycerides which could be mentioned; and, to the best of the Applicants' belief, such synthetic triglycerides would be expected to be of no value or no practical values for the rigid requirements which must be served by lubricants for the purposes of the Applicants' present invention. Even as to the identified synthetic triglycerides which are referred to as being previously used, they are stated by Baur as not being satisfactory in that the stated requirements of a satisfactory lubricant fulfill said requirements only in part. It is clear that the foregoing disclosure of the Baur patent contains no teaching of synthetic esters of oleic acid, as specifically recited in the present application; and is devoid of any suggestion whatever of the use of peanut oil, a natural product.

The actual invention of the Baur patent, however, involves, as the lubricants for the deep-drawing of containers from aluminum or aluminum alloy strip, a composition consisting essentially of a minimum of 60% of a lubricant in the form of an aluminum or magnesium salt of a saturated $C_{11}$ to $C_{19}$ monocarboxylic acid or mixtures thereof as the main constituent, and from 10 to 30% of at least one dispersion agent so that the said lubricant may be deposited on the surface of the aluminum strip or stock from a dispersion. Illustrative examples of Baur lubricating agents are aluminum tristearate, magnesium distearate, and mixtures of aluminum tristearate and magnesium distearate. The Baur patent points out that such illustrative lubricating agents can be applied on an industrial scale only with great difficulty; and, therefore, to overcome such difficulty, said lubricant is admixed with certain agents which act as dispersion agents in amounts of 10% to 30%. The dispersion agents are of widely different character, and include such substances as (1) synthetic triglycerides [no examples thereof are disclosed]; (2) paraffin oils; (3) poly-isobutenes; (4) aliphatic $C_4$ to $C_{16}$ alcohols; (5) ethyl or methyl alcohol esters of $C_{11}$ to $C_{17}$ monocarboxylic acids; (6) $C_3$ to $C_6$ alcohol esters of saturated $C_{11}$ to $C_{17}$ monocarboxylic acids; and (7) aliphatic $C_1$ to $C_6$ alcohol esters of -oxymonocarboxylic acid. Methyl and ethyl esters of $C_{11}$ to $C_{17}$ monocarboxylic acids are stated to be especially useful. An oxidation inhibitor agent is added in those instances (in particular where synthetic glycerides are used as the dispersion agents) where oxidation of such dispersion agents causes the lubricant film to become sticky. The preparation of the dispersion compositions is described in Column 4, Lines 60–68, extending over to Column 5, Lines 1–8, and involves heating the mixture of the ingredients for 6 to 8 hours. One or both sides of the aluminum stock may be coated with the Baur lubricant dispersions. The teachings of the Baur patent are, plainly, foreign and impertinent to the Applicants' invention.

In connection with this same situation, we point out that we are also aware of the U.S. patent to Barker et al. (U.S. Pat. No. 2,938,262). This patent has nothing to do with the manufacture of seamless drawn and ironed containers, and is totally devoid of any disclosure, suggestion or teaching whatever concerning the manufacture of seamless drawn and ironed containers of aluminum stock. It is limited and directed to a process for the cold reduction of strip ferrous and non-ferrous metals (especially steel) in steel mill operations in which steel strip is rolled in mills at high speed (for instance, of the order of about 5,000 feet per minute) to effect the reduction of the thickness of strip steel of the order, for instance, of ten-fold, as, for example, from 0.080-inch thickness to 0.0087-inch thickness, to produce coils of substantially reduced steel strip thicknesses. In carrying out such cold reduction of the strip metal, the metal, prior to being passed through the reducing rolls of the mill, is disclosed as being coated with a heat-processed or heat-treated lubricant selected from the group of fats, oils and greases. Among such fats, oils and greases disclosed by the Barker et al patent are lard; hydrogenated fats and oils like "Crisco" (which, as is well-known, is a solid at room temperature); corn oil; peanut oil; or blends of cottonseed oil and corn oil, which may or may not be hydrogenated. A preference is stated in the patent for semi-solid heat-processed edible fats, oils and greases.

It is critical to the process of the Barker et al patent that the fats, oils and greases be heat-processed or heat-treated, at temperatures ranging from about 200° F. to about 500° F. for from about 6 to about 72 hours, prior to use as the lubricant in the specific invention of the Barker et al process. The Barker et al patent discloses, in Column 2, Lines 38–46, that, although the chemical literature is replete with results of theoretical investigations seeking to learn the nature of the chemical reactions which occur during the heat treatment of various fats and oils, Barker et al state that they were not able to identify the remarkable improvement in rolling properties effected by the foregoing-described heat treatment with any specific chemical changes.

It is also to be noted that, in the "typical" run, described in the Barker et al patent (Column 3, Lines 25–35), the heat-treated lubricant is admixed with water, prior to use in the Barker et al process, in a ratio of 1 part of the heat-treated lubricant to 10 parts of water at the first three stands of the five-stand tandem mill, and in a ratio of about 1 part of the heat-treated lubricant to 8 parts of water at the last two stands; and that, at times, the ratio of premixed water and heat-treated lubricant may run between the extreme limits of 1:1 and 20:1. Cooling of the metal strip is effected in the customary manner while passing through the mill by flooding with water.

Wholly apart from the fact that the Barker et al patent neither teaches nor suggests anything, and is devoid in its teachings, as to the production of seamless drawn and ironed containers of aluminum stock, it is to be noted that, among the lubricants disclosed by Barker et al in their particular process, those lubricants which they prefer (for instance, lard; hydrogenated fats and oils such as "Crisco"; and semi-solid fats, oils and greases) are unsatisfactory and of no practical value as lubricants in the method of the production of seamless drawn and ironed containers of aluminum stock. Moreover, in the practice of the method of our invention, as described below, there is no requirement for the heat-treatment of the peanut oil prior to the use thereof in our method of forming seamless drawn and ironed containers of aluminum stock, ordinary peanut oil, in itself, being highly effective, and it is unnecessary to resort to any heat-treatment procedure such as described and which is essential to the invention of the Barker et al patent. In short, the disclosure of heat-treated peanut oil, among other heat-treated fats, oils and greases as lubricants in the process of the Barker et al process, provides no teaching whatever of the use of peanut oil as a lubricant in the method of forming seamless drawn and ironed containers of aluminum stock.

It is also in order to point out that the phenomena involved in rolling operations, as in the Barker et al patent; and the drawing (which usually also encompasses redrawing) and the ironing operations involved in the making of drawn and ironed containers from aluminum stock are distinctly different from each other in that they represent situations in which materially different metal flow characteristics and stress systems are involved and that so-called rolling oils are, generally speaking, commonly of no practical value as lubricants for use in the making of drawn and ironed containers from aluminum stock. As is well-known to the art of making metal cans by a drawing and an ironing operation, the drawing step is a procedure for forming sheet metal between an edge-opposing punch and a die (commonly called draw ring) to produce a cup, box or shell-like part. In can-making, a cylindrical cup is produced by this process: A disc-like blank is punched out from the work metal and bent over and wrapped around a so-called punch nose. At the same time, the outer portions of the blank move rapidly towards the center of the blank until they flow over the die radius as the blank is drawn into the die cavity by the punch. The circumferential gathering action of the outer elements of the metal blank as they are pulled towards and forced through the die cavity procedures a thickening of the side wall of the cup. The cup wall thickness is controlled by controlling the gap between the punch and the die. Some ironing or wall thinning may take place if this above-mentioned gap is small. The draw die or the draw ring is not, however, designed to be used as an ironing ring, as will be disclosed below. Therefore, basically, in a drawing operation, one produces a cup having the wall thickness almost the same as the starting thickness of the base sheet metal.

In the so-called redrawing step which, as noted above, is commonly considered as a part of the drawing step, the drawn cup is reduced in diameter by setting up a similar metal gathering operation by pushing the bigger diameter cup through a smaller diameter redraw-ring. Because the cup now reduces in diameter, it gains length (becomes tall). In the redrawing process too, as in the drawing process, there is no significant change of the wall thickness. In the ironing procedure, the wall thickness of the drawn cup or redrawn cup is reduced (ironed) to a controlled amount by controlling the gap between the punch and the ironing die. The diameter remains the same, unlike in drawing or redrawing. Therefore, the gain in height or length comes from wall thickness reduction only.

There is a drastic difference between the design of the draw-ring and the ironing ring. The stress systems set in during these operations are different; and so, also, are the frictional forces. The heats generated in the two operations are also different; the heat generated is much higher in the ironing operation than in the drawing operation. Therefore, the lubrication and cooling requirements are very different, being much more drastic in the ironing than in the drawing. (These matters are, per se, well-known to the art of can-making by drawing and ironing procedures, and are depicted in part in FIG. 1 of "Metals Handbook", American Society for Metals, 8th edition, Volume 4 (Forming), Page 162; and, in other part, in FIGS. 2, 3 and 4 of "Aluminum Transformation Technology and Application—1981", American Society for Metal, Pages 236, 237 and 238 (Proceedings of the Second International Symposium, Buenos Aires, Argentina—Aug. 24–26, 1981).

The foregoing facts play an important role in attempting to arrive at lubricants which meet the rigid requirements to be useful for manufacturing cans by a drawing and ironing procedure, and lubricants which are used in other environments such as those disclosed, for instance, in the aforementioned U.S. Pat. Nos. 4,237,021 and 2,938,262, and account for the fact that the search for suitable lubricants for use in can manufacturing drawing and ironing procedures has been a long ongoing one.

SUMMARY OF THE INVENTION

We have discovered, surprisingly, that, when forming seamless, drawn and ironed containers from aluminum stock, which containers have a bottom wall and an integral sidewall, all lubricants in the cooling fluid can be eliminated by applying a thin layer or coating of peanut oil (that is, unemulsifed peanut oil) to the stock material before the cupping operation is initiated. We have also descovered that peanut oil does not solidify on the can-forming machine, thus avoiding the necessity for frequent or constant cleaning. Peanut oil also cleans off the can surface easily, using mild detergents, and it is readily available and relatively inexpensive. It is particularly surprising that peanut oil is so satisfactory since, as noted above, U.S. Pat. No. 3,826,675 states that a number of naturally-occurring vegetable oils (such as cottonseed oil and palm oil) tend to oxidize to a solid film which is no longer a good lubricant after a relatively short period of storage.

Peanut oil is a triglyceride of a mixture of fatty acids or aliphatic carboxylic acids, the nature and contents of said acids being somewhat variable. An illustrative example of the mixture of acids and the proportions thereof in the triglycerides which comprise peanut oil is primarily oleic acid, approximately 55 to 60%; linoleic acid, approximately 22 to 26%; palmitic acid, approximately 6 to 8%; stearic acid, approximately 3 to 5%; behenic acid, approximately 3%; and arachidic acid, approximately 2 to 2.5%. Peanut oils, as prepared by conventional processes or refining processes, have been unexpectedly discovered by us to by highly satisfactory as lubricants in the method of manufacturing drawn and ironed cans of aluminum stock. Other conventionally-produced peanut oils can also be effectively used as, for example, cold-pressed peanut oils. Typical cold-pressed peanut oils comprise essentially triglycerides of the following fatty acids in the approximately following proportions: oleic acid, 56%; linoleic acid, 26%; palmitic acid, 8.3%; stearic acid, 3.1%; behenic acid, 3.1%; arachidic acid, 2.4%; lignoceric acid, 1.1%. Traces of capric acid and lauric acids have been reported in some samples. Unsaponifiable matter, 0.8%. The unsaponifiable matter includes very low proportions of tocopherols, 0.02 to 0.0595%; sterols (0.19 to 0.25%); squalene (0.027%), and very minor proportions of other complex hydrocarbons.

In place of peanut oil, one can utilize what may be characterized as a synthetic peanut oil which would result from esterifying a mixture of the foregoing fatty or aliphatic carboxylic acids, or their acyl chlorides or bromides or their methyl esters, in the approximately above-stated ratios with an amount of glycerol to produce the triglycerides, although this approach would be uneconomical. The term "peanut oil" will be understood to include such synthetically-produced peanut oils and which would possess a low solidification temperature, similar to that of peanut oil, which is around 0° C. or slightly below.

While, as stated, peanut oil has been discovered to be exceptionally satisfactory as a lubricant in the forming of seamless, drawn and ironed containers from aluminum stock, which containers have a bottom wall and an integral sidewall, and its use represents the best and most important embodiment of our invention, it has further been discovered that certain synthetically-produced oleic acid esters of aliphatic polyhydric alcohols containing at least three hydroxyl groups are also very satisfactory as lubricants for the same purposes which have been described above in regard to the use of peanut oil as the lubricant. Such synthetically-produced oleic acid esters (that is, unemulsified synthetically-produced oleic acid esters) which are useful as lubricants in accordance with the present invention are, particularly, the predominately trioleic acid esters of said aliphatic polyhydric alcohols; but, where the aliphatic polyhydric alcohol contains four or more hydroxyl groups, as in pentaerythritol and in aliphatic hexahydric alcohols such as sorbitol, mannitol and dulcitol, the tetra- and hexa-oleic acid esters can be used. It is, however, especially desirable, in regard to the synthetically-produced oleic acid esters of said polyhydric alcohols, that the trioleic acid esters be utilized or said esters which contain predominately trioleic acid esters of the said aliphatic polyhydric alcohols. Commercial sources of oleic acid can be used in preparing the aforesaid esters such as Red Oil and so-called White Oleic Acid; but crude oleic acid containing unduly high contents of acids with two or more double bonds, such as are prepared from tall oil, should generally not be used if optimal results are to be obtained.

The aliphatic polyhydric alcohols of which said synthetically-produced oleic acid esters are useful in the practice of our present invention include, by way of examples, glycerol, pentaerythritol, and aliphatic hexahydric alcohols of which sorbitol, mannitol and dulcitol are illustrative and of which aliphatic hexahydric alcohols sorbitol is preferred.

Illustrative examples of the synthetically-produced oleic acid esters of the polyhydric alcohols which are useful as lubricants in the practice of our present invention are glycerol trioleate, pentaerythritol tetraoleate, sorbitol trioleate, mannitol trioleate, sorbitol tetraoleate and mannitol tetraoleate, particularly glycerol trioleate and sorbitol trioleate.

The aforesaid synthetically-produced oleic acid esters of the polyhydric alcohols can be produced by reacting the polyhydric alcohols with oleic acid in the requisite proportions to produce said esters, or with oleyl chloride or bromide, or with the methyl esters of oleic acid, in the presence or absence of catalysts, in accordance with esterification procedures which are well-known to the art. When reference is made herein and in the Claims to oleic acid esters of aliphatic polyhydric alcohols containing at least three hydroxyl groups and wherein three or more of said hydroxyl groups of said aliphatic polyhydric alcohols are esterified with oleic acid, or, for example, to glycerol trioleate or to sorbitol trioleate, it will be understood that it is intended to cover such esters which are produced synthetically and by the procedures generally described above.

It will also be understood that mixtures of peanut oil and one or more of said oleic acid esters, in various proportions in relation to each other, can also effectively be used; and, further, that mixtures of two or more of said oleic acid esters, in various proportions in relation to each other, can also be utilized, it being understood that, where the foregoing mixtures are used, they are in the form of homogeneous compositions or solutions.

Except as otherwise indicated hereafter, the invention will, for convenience as well as because the use of peanut oil represents the best embodiment of the present invention of which we are presently aware, be described in terms of the use of peanut oil as the lubricant.

In accordance with the best manner of the practice of our invention, aluminum stock material that is to be used for forming a drawn and ironed seamless container first has a thin layer of peanut oil applied to at least one surface, and preferably both surfaces. A disc is cut from the metal blank and formed into a shallow cup without the use of any additional lubricant or coolant. The shallow cup is then further drawn and ironed, as described above, to produce a seamless container which, again, is done without the use of any additional lubricant in the drawing and ironing machine.

In the cupping operation, the peanut oil is applied as such, or neat. This in sharp contrast to that working embodiment in the Barker et al patent wherein, in the unrelated procedure of the Barker et al patent, as referred to above, in the cold reduction of the strip metal, such as steel, in which the strip is fed at high speed to reduce the thickness of the strip of the order of ten-fold, as noted above, the heat-treated lubricant is premixed with from equal parts of said lubricant with water to of the order of 10 to 8 parts of water per part of said lubricant. This type of procedure would be inoperative, or at least most unsatisfactory, in the initial cupping operation in the making of drawn and ironed containers of aluminum stock. In the ironing step of said can-making method, substantial quantities of water are used to effect the necessary cooling of the tooling. In any event, no matter how the Barker et al patent is viewed, no one versed in the art of making drawn and ironed containers of aluminum stock could arrive at the invention of our present application because the actual teachings and procedures of the Barker et al patent, on the one hand, and our drawn and ironed can-making operations, on the other hand, are separate and distinct procedures. In the practice of our invention, peanut oil is not used as a rolling oil, and the oils which are commonly characterized and utilized as rolling oils are generally used in environments which are unrelated to the making of drawn and ironed containers of aluminum stock and, as a class, are not suitable as lubricants in said can-making operations. Rolling and ironing are distinct and different processes, and involve operations in which metal flow is an operation which is far more demanding in ironing operations than in rolling operations.

More specifically, according to one embodiment of our invention, the thin layer of peanut oil has a generally uniform distribution or thickness on the aluminum stock surface, desirably 0.5–3 mg./in.$^2$. The peanut oil films can, however, be used in amounts significantly less than 0.5 mg./in.$^2$. Coatings of greater than 3.0 mg./in.$^2$ also produce acceptable commercial cans, but the cost-benefit ratio of such thicker films makes it economically unattractive. Most commonly, coatings of about 1 to about 2 mg./in.$^2$ are used. The scope of the subject invention, therefore, is intended to cover such lower and higher weight distributions.

While the manner of applying the peanut oil to the aluminum stock material is not critical in carrying out our present invention, the peanut oil is most desirably applied to the aluminum stock material prior to the point when it is fed to the blanking and/or cupping machine. The peanut oil can, however, be applied in other ways. For example, it can be applied to blank discs before they are formed into cups in the cupping machine. Preferably, the peanut oil coating is applied to each side of the aluminum stock, although it can be applied as a coating to only one side of the sheet, sufficient transfer of the peanut oil to the uncoated side occurring during the normal coiling or stacking of the aluminum stock. It is, however, more advantageous initially to apply the peanut oil to both sides of the blank discs.

It has been determined that cans can be formed very effectively from an aluminum stock material having a layer of peanut oil applied to one or both surfaces of the stock material in a layer or coating weight of approximately 0.5 mg./in.$^2$ or somewhat more on each surface, and such pretreated stock material is then utilized in forming a seamless drawn and ironed container that has a bottom wall and an integral sidewall in the general manner set forth above. By applying the peanut oil to the aluminum stock material before forming such stock material into a can, we have found that all additional lubricants in the drawing and ironing process can be eliminated; and it is only necessary to provide the body maker with a water coolant that has a small amount of a conventional rust inhibitor and a conventional sequestering agent therein to maintain the tooling below a predetermined temperature. No additional lubricant is needed because a sufficient amount of the peanut oil remains on the cups after the cupping operation. Furthermore, since peanut oil is water-insoluble, it is not washed off in the body maker by the water coolant of the body maker, and thereby remains on the can surface for lubrication during the ironing process.

A series of experiments was performed using three sets of sheets of aluminum stock material. The peanut oil was applied to one set of sheets to provide a lubricating layer of approximately 1.25 mg./in.$^2$ weight distribution on each side. On the second set of sheets, glycerol trioleate was applied to provide a layer thickness or weight distribution of 2.5 mg./in.$^2$ for each side. On the third set of sheets, sorbitol trioleate was applied as the lubricant to a layer thickness of 1.25 mg./in.$^2$ per side. The sheets, in each case, were then converted into cups, and subsequently into cans, utilizing a commercially available cupper and body maker in the manner previously discussed. The cups were converted to finished containers in the body maker without using any additional lubricant and utilizing only tap water as a coolant. Approximately a thousand of such cups and containers were produced with each lubricant. Inspection of the finished containers showed that they had a shiny outside surface and a scratch-free inside surface in each case. The containers were then cleaned using standard cleaning solutions with less than the present standard recommended concentration, yet commercially acceptable cleaning of the container surfaces was achieved.

The elimination of the water-emulsion oils from the process and substitution of the peanut oil results in appreciable cost savings in the lubricant alone, and also provides additional savings in the use of milder cleaners and lower cleaning temperatures since less cleaning agent is required. Furthermore, peanut oil provides better lubrication for the tooling than water-lubricant mixtures, as currently used. This is believed to result from the fact that the peanut oil is initially located directly between the tooling and the container surface interface, and also from the fact that the peanut oil permits ironing of the metal body without deterioration. Also, the presence of the peanut oil on the surface which becomes the inner surface of the container tends to aid in stripping the ironed container from the punch.

It will be clear to those skilled in the art, in light of the above teachings of the present invention, that various modifications can be made in the details of carrying out the invention, but without departing from the principles disclosed and the scope thereof which is more clearly set forth in the appended claims.

The low rate of oxidation of peanut oil allows it to be applied to the stock material at the mill and stored for extended periods of time. It can also be applied at any point between the mill and the cupper. The peanut oil eliminates the necessity of adding any lubricant in the water coolant, which is necessary to operate at commercial rates. However, it will be appreciated that it is usually necessary to incorporate a rust inhibitor into the coolant for the tooling.

We claim:

1. A method of forming a seamless drawn and ironed container of aluminum stock, said container having a bottom wall and an integral sidewall, comprising the steps of (a) applying a thin layer of a lubricant to at least one of the two surfaces of said aluminum stock, said lubricant consisting essentially of unemulsified (i) peanut oil or (ii) at least one oleic acid ester of an aliphatic polyhydric alcohol containing at least three hydroxyl groups and wherein three or more of said hydroxyl groups of said aliphatic polyhydric alcohol are esterified with oleic acid, or mixtures of (i) and (ii); and (b) converting said aluminum stock into a drawn and ironed container from said stock material without applying any additional lubricant thereto.

2. A method of forming a seamless drawn and ironed container of aluminum stock, said container having a bottom wall and an integral sidewall, comprising the steps of (a) applying a thin layer of a lubricant consisting essentially of unemulsified peanut oil to at least one of the two surfaces of said aluminum stock; and (b) converting said aluminum stock into a drawn and ironed container from said stock material without applying any additional lubricant thereto.

3. The method of claim 1, wherein the layer of said lubricant is about 0.5–3 mg./in.$^2$ film weight.

4. The method of claim 3, wherein the layer of said lubricant is about 1 to 2 mg./in.$^2$ film weight.

5. The method of claim 1, wherein the layer of the lubricant is applied to the two surfaces of said aluminum stock.

6. The method of claim 1, wherein said lubricant is sorbitol trioleate.

7. The method of claim 1, wherein said lubricant is glycerol trioleate.

8. A method of forming a seamless drawn and ironed container of aluminum stock, said container having a bottom wall and an integral sidewall, comprising the steps of (a) applying a thin layer of a lubricant in the range of about 0.5–3 mg./in.$^2$ film weight to at least one of the two surfaces of said aluminum stock, said lubricant consisting essentially of unemulsified (i) peanut oil or (ii) at least one oleic acid ester of an aliphatic polyhydric alcohol containing at least three hydroxyl groups and wherein three or more of said hydroxyl groups of said aliphatic polyhydric alcohol are esterified with oleic acid, or mixtures of (i) and (ii);

(b) converting said aluminum stock into a cup; and (c) forming a drawn and ironed container therefrom without applying additional lubricant thereto.

9. A method of forming a seamless aluminum container having integral bottom and sidewalls from an aluminum material, including the steps of (a) applying a thin layer of a lubricant to a surface of said aluminum material, said lubricant consisting essentially of unemulsified (i) peanut oil or (ii) at least one oleic acid ester of an aliphatic polyhydric alcohol containing at least three hydroxyl groups and wherein three or more of said hydroxyl groups of said aliphatic polyhydric alcohol are esterified with oleic acid, or mixtures of (i) and (ii); and (b) converting said aluminum material into said seamless container without applying additional lubricant thereto.

10. The method of claim 1, in which cooling is effected during the ironing step using as the coolant essentially lubricant-free water.

11. The method of claim 2, in which cooling is effected during the ironing step using as the coolant essentially lubricant-free water.

12. A method of forming a seamless drawn and ironed container having a bottom wall and an integral sidewall from aluminum stock material, comprising the steps of applying a thin layer of unemulsified peanut oil as the lubricant in the range of about 1 to about 2 mg/in.$^2$ thickness equivalent to one surface of said aluminum stock material, converting said aluminum stock material into a cup, and forming a drawn and ironed container from said aluminum stock material in a multi-staged ironing process while retaining at least some of said lubricant on said surface throughout said ironing process.

13. A method as defined in claim 12, in which said thin layer has a thickness of about 1.25 mg/in.$^2$.

14. A method as defined in claim 12, further including flowing a liquid water coolant to the other surface of said aluminum stock material while a drawn and ironed container is being ironed and in which said liquid water coolant is devoid of any lubricant.

* * * * *